US006303540B1

(12) United States Patent
Fukuchi et al.

(10) Patent No.: US 6,303,540 B1
(45) Date of Patent: Oct. 16, 2001

(54) THERMALLY SENSITIVE RECORDING MEDIUM

(75) Inventors: Tadakazu Fukuchi; Kaoru Hamada; Yuji Tsuzuki; Yoshihide Kimura, all of Shinjuku-ku; Tomoaki Nagai, Kita-ku; Yutaka Wakita, Ishinomaki, all of (JP)

(73) Assignee: Nippon Paper Industries Co Ltd, Tokyo (JP)

( * ) Notice: Subject to any disclaimer, the term of this patent is extended or adjusted under 35 U.S.C. 154(b) by 0 days.

(21) Appl. No.: 09/431,052

(22) Filed: Nov. 1, 1999

(30) Foreign Application Priority Data

Nov. 2, 1998 (JP) ..... 10-311608

(51) Int. Cl.[7] ..... B41M 5/30
(52) U.S. Cl. ..... 503/209; 503/216
(58) Field of Search ..... 503/208, 209, 503/216

(56) References Cited

FOREIGN PATENT DOCUMENTS

| | | |
|---|---|---|
| 0131631 | 1/1985 | (EP) . |
| 0769391 | 4/1997 | (EP) . |
| 0778157 | 6/1997 | (EP) . |
| 0860429 | 8/1998 | (EP) . |

OTHER PUBLICATIONS

Japanese Laid–open Publication 56–040587 (English abstract).
Japanese Laid–open Publication 7–149713 (English abstract).
Japanese Laid–open Publication 10–029969 (English abstract).
Japanese Laid–open Publication 10–297089 (English abstract).

*Primary Examiner*—Bruce H. Hess

(57) ABSTRACT

A thermally sensitive recording medium which has thermally sensitive recording layer containing colorless or pale colored basic leuco dye and organic color developer as main components on a substrate, wherein said thermally sensitive recording layer contains diphenylsulfone bridgeable type compound represented by general formula (1) and at least one compound represented by general formula (1).

(1)

In general formula (2), X and Y can be different and indicates a saturated or an unsaturated liner or grafted hydrocarbon group of carbon number 1–12 which can possess ether bond, or indicates (a)

or (b)

wherein R indicates a methylene group or an ethylene group, T indicates a hydrogen atom or an alkyl group of carbon number 1–4, and $R_1$–$R_6$ independently indicate a halogen atom, an alkyl group of carbon number 1–6, or an alkenyl group, further, m, n, p, q, r, t indicate an integer number of 0–4 and when are bigger than 2, $R_1$–$R_6$ can be different, and a is an integer of 0–10.

(2)

In general formula (2), $R_7$ represents an alkyl group of carbon number 1–6 or an electron attracting group, u is an integer of 0–2.

2 Claims, No Drawings

THERMALLY SENSITIVE RECORDING MEDIUM

BACKGROUND OF THE INVENTION

The present invention relates to a thermally sensitive recording medium which has good preserving stability of developed color image and good color developing sensitivity.

DESCRIPTION OF THE PRIOR ART

In general, a thermally sensitive recording medium is obtained by following procedure. Namely, a colorless or pale colored basic leuco dye and an organic color developer such as phenolic compound are respectively ground to fine particles and mixed together, a binder, a filler, a sensitizer, a slipping agent and other additives are added, and a coating is obtained. The obtained coating is coated on a substrate such as paper, synthetic paper, film or plastic, thus a thermally sensitive recording medium is obtained. The thermally sensitive recording medium develops color by a instantaneous chemical reaction by beating with a thermal head, a hot stamp, a thermal pen and laser ray, and a recorded image can be obtained. The thermally sensitive recording medium is widely used in a field of a facsimile and a terminal printer of computer, an automatic ticket vending machine and a recorder of measuring equipment. Recently, along with the diversity of recording equipment and the progress of high quality machine, the high speed printing and high speed image recording are becoming possible, and more superior quality is required for the recording sensitivity of thermally recording medium.

As the method to satisfy said requirement, the method to use a dye together with a color developer and a sensitizer. For example, in a case that the color developer is a phenolic compound represented by bis-phenol A, p-benzylbiphenyl (Japanese Patent Laid open Publication 60-82382), p-benzyloxybenzoicbenzoate (Japanese Patent Laid open Publication 57-201691) and benzylnaphtyl ether (Japanese Patent Laid open Publication 58-87094) are used as the desirable sensitizer. When a sensitizer is used, at first, the sensitizer is molten by heating and the molten sensitizer dissolves basic dye and color developer and mixes them by molecular size level, and the color developing reaction is caused. Therefore, the kind of sensitizer, basic dye and color developer to be used must be chosen by a careful consideration.

Especially, in a case that the recording sensitivity is improved by use of a sensitizer, sometimes, it is hard to maintain the preserving stability of recorded image. Concretely, when skin fat is stuck or a plasticizer (DOP, DOA or others) contained in polyvinyl chloride wrapping film is contacted, the defects of remarkable deterioration of image density or the disappearance of recorded image are still serious problems. Further, recently, along with the improvement of an use in the field of label to which a reliance of recorded image is strongly required, the recording materials which displays strong preserving stability to a plasticizer contained in wrapping materials and fats. The thermally sensitive recording medium which uses various additives such as dye, color developer or a preserving stabilizer are disclosed, however, these are not sufficient ones.

THE OBJECT OF THE INVENTION

The object of this invention is to provide a thermally sensitive recording medium which has an excellent stability to plasticizer, and whose recording sensitivity is remarkably improved.

The inventors of this invention have carried out an intensive study to develop the thermally sensitive recording medium which has above mentioned features, and have found that the recording sensitivity can be remarkably improved by an use of diphenylsulfone bridgeable type compound as a color developer together with an aromatic compound possessing aminosulfonyl ($—SO_2NH_2$) group as a sensitizer, and accomplished the present invention.

That is, the present invention is a thermally sensitive recording medium, comprising a thermally sensitive recording layer prepared on a substrate, said thermally sensitive recording layer contains a colorless or pale colored leuco dye and an organic color developer as main components, wherein said thermally sensitive recording layer contains diphenylsulfone bridgeable type compound represented by general formula (1) as an organic color developer and at least one compound represented by general formula (2). And, the sensitivity can be more improved without hurting above mentioned features, by further containing at least one compound represented by general formula (3), general formula (4) or general formula (5).

(1)

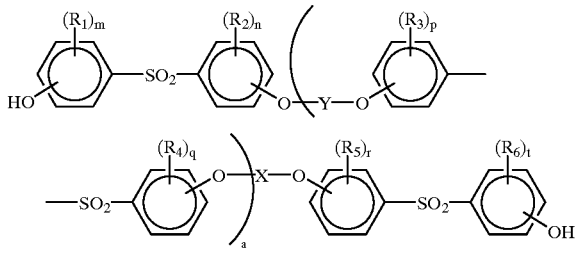

in this formula, X and Y can be different and indicates a saturated or an unsaturated liner or grafted hydrocarbon group of carbon number 1–12 which can possess an ether bond, or indicate (a)

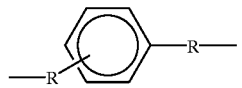

or (b)

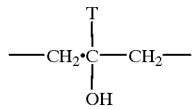

wherein R indicates a methylene group or an ethylene group, T indicates a hydrogen atom or an alkyl group of carbon number 1–6. $R_1$–$R_6$ independently indicate a halogen atom, an alkyl group of carbon number 1–6, or an alkenyl group. Further, m, n, p, q, r, t indicate an integer of 0–4 and when are bigger than 2, $R_1$–$R_6$ can be different. And a is an integer of 0–10.

(2)

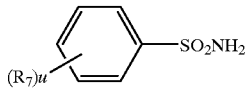

in this formula, $R_7$ represents an alkyl group of carbon number 1–6 or an electron attracting group, u is an integer of 0–2.

(3)

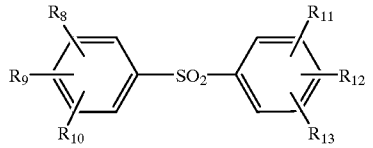

$R_8$–$R_{13}$, represent a hydrogen atom, an alkyl group, a halogen atom, a nitro group, an alkoxy group, a cyano group or an alyloxy group.

(4)

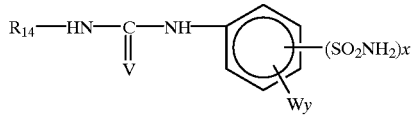

in this formula, V represents an oxygen atom or sulfur atom and $R_{14}$ represents an un-substituted or a substituted phenyl group, a naphthyl group, an aralkyl group, a lower alkyl group of carbon number 1–6, a cycloalkyl group of carbon number 3–6 or a lower alkenyl group of carbon number 2–6. W represents a lower alkyl group of carbon number 1–6 or an electron attractive group. y is an integer of 1–4 and x is an integer of 1–5, wherein $y+x \leqq 5$.

(5)

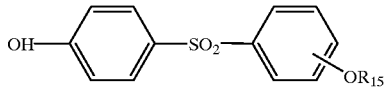

in this formula $R_{15}$ indicates an un-substituted or a substituted alkyl group of carbon numder 1–4, an aralkyl group, a phenyl group or a hydrogen atom.

In the present invention, at least one kind of diphenyl sulfone represented by general formula (1) is used as an diphenylsulfone bridgeable type compound as an organic color developer. The diphenylsulfone bridgeable type compound represented by general formula (1) is disclosed in Japanese Patent Laid Open Publication 10-29969.

In general formula (1), the concrete examples of groups represented by X and Y are mentioned as follow. That is, methylene group, ethylene group, trimethylene group, tetramethylene group, pentamethylene group, hexamethylene group, heptamethylene group, octamethylene group, nonamethylene group, decamethylene group, undecamethylene group, dodecamethylene group, methylmethylene group, dimethylmethylene group, methylethylene group, methyleneethylene group, ethylethylene group, 1,2-dimethylethylene group, 1-methyltrimethylene group, 1-methyltetramethylene group, 1,3-dimethyltrimethylene group, 1-ethyl-4-methyl-tetramethylene group, vinylene group, propenylene group, 2-butenylene group, ethynylene group, 2-butynylene group, 1-vinyl ethylene group, ethyleneoxyethylene group, tetramethyleneoxytetramethylene group, ethyleneoxyethylene group, ethyleneoxymethyleneoxyethylene group, 1,3-dioxane-5, 5-bismethylene group, 1,2-xylyl group, 1,3-xylyl group, 1,4-xylyl group, 2-hydroxytrimethylene group, 2-hydroxy-2-methyltrimethylene group, 2-hydroxy-2-ethyltrimethylene group, 2-hydroxy-2-propyltrimethylene group, 2-hydroxy-2-isopropyltrimethylene group and 2-hydroxy-2-butyltrimethylene group can be mentioned.

Alkyl or alkenyl group of $R_1$–$R_6$ is an alkyl group of $C_1$–$C_6$ or an alkenyl group of $C_1$–$C_6$, and as a concrete example, methyl group, ethyl group, n-propyl group, isopropyl group, n-butyl group, sec-butyl group, tert-butyl group, n-pentyl group, isopentyl group, neopentyl group, tert-pentyl group, n-hexyl group, isohexyl group, 1-metylpentyl group, 2-methylpentyl group, vinyl group, allyl group, isopropenyl group, 1-propenyl group, 2-butenyl group, 3-butenyl group, 1,3-butandienyl group and 2-methyl-2-propenyl group can be mentioned. And a halogen atom indicates chloride, bromine, fluorine or iodine.

In this invention, as the diphenylsulfone bridgeable type compound represented by general formula (1), several kinds of compound whose substitution group and/or a number is different can be used by mixing together with, and the mixing ratio is voluntarily selected. And as the mixing method, mixing by powder, mixing in aqueous solution or the method to prepare plural kinds of diphenylsulfone bridgeable type compounds simultaneously can be mentioned and is not restricted.

In a case of mixing use of several kinds of diphenylsulfone bridgeable type compound represented by general formula (1), the most desirable one is the composition which contains more than two kinds of compound represented by general formula (6) whose a number alone is different. The preparation method of said compound is simple and by changing the reacting ratio of starting materials, the compounds whose a number is different can be prepared simultaneously by desired ratio.

(6)

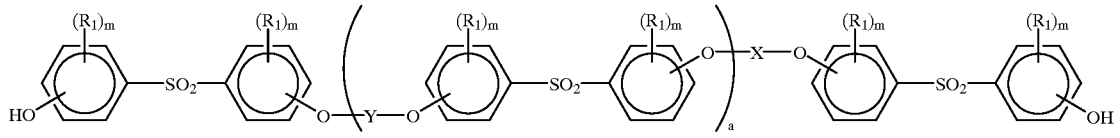

in this formula, X, Y, $R_1$, m and a are same to above.

As a concrete example of compound represented by general formula (1), following compounds can be mentioned.

(1-1) 4,4'-bis[4-[4-(4-hydroxyphenylsulfonyl)phenoxy]-2-trans-butenyloxy]diphenylsulfone
(1-2) 4,4'-bis[4-(4-hydroxyphenylsulfonyl)phenoxy-4-butyloxy]diphenylsulfone
(1-3) 4,4'-bis[4-(4-hydroxyphenylsulfonyl)phenoxy-3-propyloxy]diphenylsulfone
(1-4) 4,4'-bis[4-(4-hydroxyphenylsulfonyl)phenoxy-2-ethyloxy]diphenylsulfone
(1-5) 4-[4-(4-hydroxyphenylsulfonyl)phenoxy-4-butyloxy]-4'-[4-(4-hydroxyphenylsulfonyl)phenoxy-3-propyloxy] diphenylsulfone
(1-6) 4-[4-(4-hydroxyphenylsulfonyl)phenoxy-4-butyloxy]-4'-[4-(4-hydroxyphenylsulfonyl)phenoxy-2-ethyloxy] diphenylsulfone
(1-7) 4-[4-(4-hydroxyphenylsulfonyl)phenoxy-3-propyloxy]-4'-[4-(4-hydroxyphenylsulfonyl)phenoxy-2-ethyloxy]diphenylsulfone
(1-8) 4-4'-bis[4-(4-hydroxyphenylsulfonyl)phenoxy-5-pentyloxy]diphenylsulfone
(1-9) 4,4'-bis[4-(4 -hydroxyphenylsulfonyl)phenoxy-6-hexyloxy]diphenylsulfone
(1-10) 4-[4-[4-hydroxyphenylsulfonyl]phenoxy]-2-trans-butenyloxy]-4'-[4-(4-hydroxyphenylsulfonyl)phenoxy-4-butyloxy]diphenylsulfone
(1-11) 4-[4-(-hydroxyphenylsulfonyl)phenoxy-2-trans-butenyloxy]-4'-[4-(4-hydroxyphenylsulfonyl)phenoxy-3-propyloxy]diphenylsulfone
(1-12) 4-[4-[4-(4-hydroxyphenylsulfonyl)phenoxy]-2-trans-butenyloxy]-4'-[4-(4-hydroxyphenylsulfonyl)phenoxy-2-ethyloxy]diphenylsulfone
(1-13) 1,4-bis[4-[4-[4-(4-hydroxyphenylsulfonyl)phenoxy-2-trans-butenyloxy]phenylsulfonyl]phenoxy]-cis-2-butene
(1-14) 1,4-bis[4[4-[4-(4-hydroxyphenylsulfonyl)phenoxy-2-trans-butenyloxy]phenylsulfonyl]phenoxy]-trans-2-butene
(1-15) 4,4'-bis[4-[4-(2-hydroxyphenylsulfonyl)phenoxy] butyloxy]diphenylsulfone
(1-16) 4,4'-bis[4-[2-(4-hydroxyphenylsulfonyl)phenoxy] butyloxy]diphenylsulfone
(1-17) 4,4'-bis[4-(4-hydroxyphenylsulfonyl)phenoxy-2-ethylenoxyethoxy]diphenylsulfone
(1-18) 4,4'-bis[4-(4-hydroxyphenylsulfonyl)phenyl-14-phenylenebismethyleneoxy]diphenylsulfone,
(1-19) 4,4'-bis[4-(4-hydroxyphenylsulfonyl)phenyl-1,3-phenylenebismethyleneoxy]diphenylsulfone
(1-20) 4,4'-bis[4-(4-hydroxyphenylsulfonyl)phenyl-1,2-phenylenebismethyleneoxy]diphenylsulfone
(1-21) 2,2'-bis[4-[4-[4-(4-hydroxyphenylsulfonyl)phenoxy-2-ethyleneoxyethoxy]phenylsulfonyl]phenoxy]diethyl ether
(1-22) α,α'-bis[4-[4-[4-(4-hydroxyphenylsulfonyl)phenyl-1,4-phenylenebismethyleneoxy]phenylsulfonyl] phenoxy]-p-xylene
(1-23) α,α'-bis[4-[4-[4-(4-hydroxyphenylsulfonyl)phenyl-1,3-phenylenebismethyleneoxy]phenylsulfonyl] phenoxy]-m-xylene
(1-24) α,α'-bis[4-[4-[4-(4-hydroxyphenylsulfonyl)phenyl-1,2-phenylenebismethyleneoxy]phenylsulfony] phenoxy]-0-xylene
(1-25) 2,4'-bis[2-(4-hydroxyphenylsulfonyl)phenoxy-2-ethyleneoxyethoxy]diphenylsulfone
(1-26) 2,4'-bis[4-(2-hydroxyphenylsulfonyl)phenoxy-2-ethyleneoxyethoxy]diphenylsulfone
(1-27) 4,4'-bis[3,5-dimethyl-4-(3,5-dimethyl-4-hydroxyphenylsulfonyl)phenoxy-2-ethyleneoxyethoxy] diphenylsulfone
(1-28) 4,4'-bis[3-allyl-4-hydroxyphenylsulfonyl]phenoxy-2-ethyleneoxyethoxy]diphenylsulfone
(1-29) 4,4'-bis[3,5-dimethyl-4-(3,5-dimethyl-4-hydroxyphenylsulfonyl)phenyl-1,4-phenylenebismethyleneoxy]diphenylsulfone
(1-30) 4,4'-bis[3,5-dimethyl-4-(3, 5-dimethyl-4-hydroxyphenylsulfonyl)phenyl-1,3-phenylene bismethyleneoxy]diphenylsulfone
(1-31) 4,4'-bis[3,5-dimethyl-4-(3,5-dimethyl-4-hydroxyphenylsulfonyl)phenyl-1,2-phenylenebismethyleneoxy]diphenylsulfone
(1-32) 4,4'-bis[3-allyl-4-(3-allyl-hydroxyphenylsulfonyl)1,4-phenylenebismethyleneoxy]diphenylsulfone
(1-33) 4,4'-bis[3-allyl-4-(3-allyl-4-hydroxyphenylsulfonyl) 1,3-phenylenebismethyleneoxy]diphenylsulfone
(1-34) 4,4'-bis[3-allyl-4-(3-allyl-4-hydroxyphenylsulfonyl) 1,2-phenylenebismethyleneoxy]diphenylsulfone
(1-35) 4,4'-bis[4-(4-hydroxyphenylsulfonyl)phenoxy-2-hydroxypropyloxy]diphenylsulfone
(1-36) 1,3-bis[4-[4-[4-(4-hydroxyphenylsulfonyl)phenoxy-2-hydroxypropyloxy]phenylsulfonyl]phenoxy]-2-hydroxypropane.

Further, among the compounds represented by general formula (6), the compound of a=0 is the compounds disclosed in Japanese Patent Application 7-149713, PCT Laid Open Publication WO93/06074 and WO95/33714. And concretely, 1,3-bis[4-(4-hydroxyphenylsulfonyl)phenoxy]-2-hydroxypropane,
1,1-bis[4-(4-hydroxyphenylsulfonyl)phenoxy]methane,
1,2-bis[4-(4-hydroxyphenylsulfonyl)phenoxy]ethane,
1,3-bis[4-(4-hydroxyphenylsulfonyl)phenoxy]propane,
1,4-bis[4-(4-hydroxyphenylsulfonyl)phenoxy]butane,
1,5-bis[4-(4 -hydroxyphenylsulfonyl)phenoxy]pentane,
1,6-bis[4-(4-hydroxyphenylsulfonyl)phenoxy]hexane,
α,α'-bis[4-(4-hydroxyphenylsulfonyl)phenoxy]-p-xylene,
α,α'-bis[4-(4-hydroxyphenylsulfonyl)phenoxy]-m-xylene,
α,α'-bis[4-(4-hydroxyphenylsulfonyl)phenoxy]-o-xylene,
2,2'-bis[4-(4-hydroxyphrnylsulfonyl)phenoxy]diethyl ether,
4,4'-bis[4-(4-hydroxyphenylsulfonyl)phenoxy]dibuthyl ether,
2,2-bis[4-(4-hydroxyphenylsulfonyl)phenoxy]ethylene and
1,4-bis[4-(4-hydroxyphenylsulfonyl)phenoxy]-2-butene can be mentioned.

The compound represented by general formula (1) can be obtained by the method described in International Patent Laid Open Publication WO97/16420 which reacts 4,4'-dihydroxyphenylsulfone derivatives or 2,4'-dihydroxyphenylsulfone derivatives under the presence of basic compound.

The color developer used in this invention contains one or more kinds of diphenylsulfone bridgeable type compound prepared by above mentioned method, and the compounds obtained by following synthetic examples are desirably used.

Synthetic Example 1

16.0 g (0.4 mole) of sodium hydroxide is added to 21.2 g of water and dissolved, then 50.0 g (0.2 mole) of BPS is added. Then, 14.3 g of bis(2-chloroethyl)ether is added at 105° C., reacted for 5 hours at 110–1150° C. After the reaction is over, 375 ml of water is added to the reacted solution, stirred for 1 hour at 90° C. Then cooled down to the room temperature, neutralized by 20% sulfuric acid. The crystallized solid is filtrated, and 39.3 g of white crystalline is obtained. The yield to bis(2-chloroethyl)ether is 88%. The obtained component is analyzed by high precision liquid chromatography and identified as follows. As the column, Mightysil RP-18 (product of Kanto Chemical Co., Ltd.) is used, and moving bed is $CH_3CN:H_2O:1\%H_3PO_4$= 700:300:5, and UV wave length is 260 nm.

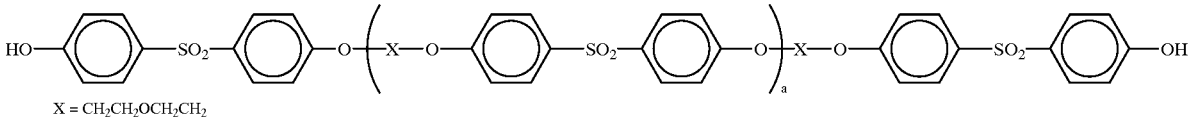

X = $CH_2CH_2OCH_2CH_2$ a=0: retention time 1.9 minutes: area % 32.9
a=1: retention time 2.3 minutes: area % 21.7
a=2: retention time 2.7 minutes: area % 12.8
a=3: retention time 3.4 minutes: area % 8.8
a=4: retention time 4.2 minutes: area % 5.8
a=5: retention time 5.4 minutes: area % 3.5
a=6: retention time 7.0 minutes: area % 2.2
a=7: retention time 9.0 minutes: area % 1.7
a=8: retention time 11.8 minutes: area % 1.3
a=9: retention time 15.4 minutes: area % 1.3

Synthetic Example 2–4

The molar ratio of BPS and bis(2-chloroethyl)ether of Synthetic 1 is changed to 1.5:1, 2.5:1, 3.0:1, and following composition can be obtained.

In a case of 1.5: 1, a=0 is 20.8, a=1 is 33.0, a=2 is 14.2, a=3 is 7.9, a=4 is 3.9

In a case of 2.5:1, a=0 is 49.6, a=1 is 25.9, a=2 is 11.4, a=3 is 5.3, a=4. is 3.4

In a case of 3.0:1, a=0 is 56.9, a=1 is 24.9, a=2 is 9.6, a=3 is 3.7, a=4 is 1.3

Synthetic Example 5

In a mixed solution of 10.0 g of 48% of aqueous solution of sodium hydroxide and 155 g of N,N'-dimethylacetoamide, 30.0 g (0.12 mole) of BPS is added. After temperature is risen to 80° C. and BPS is dissolved, 10.5 g (0.06 mole) of α, α'-dichloro-p-xylene dissolved in 15 g of xylene is dropped slowly. Then, ripened 2 hours by same temperature. After ripened, the solution is poured into 900 ml of water and the crystallized solid is filtrated. The obtained crude crystalline is rinsed by methanol, filtrated and dried up, and 19.7 g of white crystalline is obtained. Analyzed by high precision liquid chromatograph, and the main components are identified as follows.

α, α'-bis[4-(4-hydroxyphenylsulfonyl)phenoxy]-p-xylene 59.1%

4,4'-bis[4-(4-hydroxyphenylsulfonyl)pheny-1,4-phenylenebismethyleneoxy]diphenylsulfone 23.1%.

α,α'-bis[4-[4-[4-(4-hydroxyphenylsulfonyl)phenyl-1,4-phenylenebismethyleneoxy]phenylsulfonyl]phenoxy]-p-xylene 11.1%

Further, in this invention, at least one compound represented by general formula (2) is contained in the thermally sensitive recording layer. In general formula (2), $R_7$ can be a substituted group which does not hurt the sensitivity effect, and as the substituted group, a halogen atom or an alkyl group of carbon number 1–6 can be mentioned. As the concrete example of the compound indicated by general formula (2), (2-1)–(2-30) compounds can be mentioned, however not intended to be limited to them. Among these compounds, (2-2) and (2-4) are desirably used because the effect when used together with color developer obtained by Synthetic Example 1 is good.

(2-1)

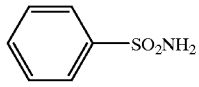

(2-2)

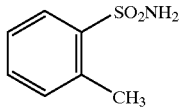

(2-3)

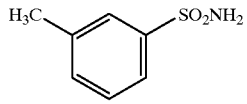

(2-4)

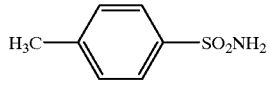

(2-5)

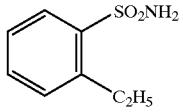

(2-6)

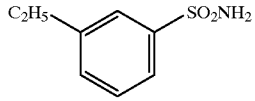

(2-7)

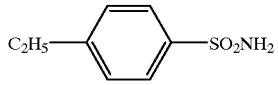

(2-8)

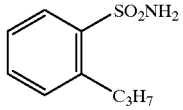

(2-9)

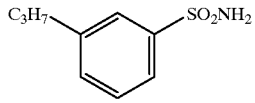

(2-10)

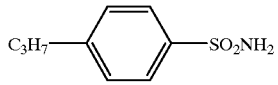

-continued (2-11)

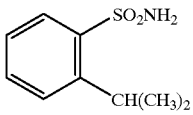

(2-12)

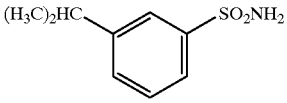

(2-13)

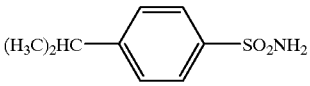

(2-14)

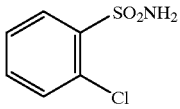

(2-15)

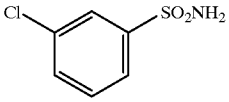

(2-16)

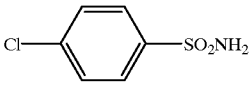

(2-17)

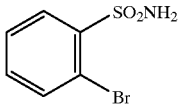

(2-18)

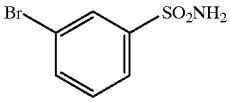

(2-19)

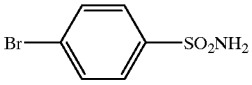

(2-20)

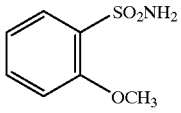

(2-21)

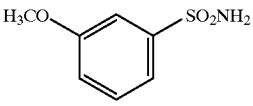

(2-22)

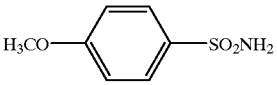

(2-23)

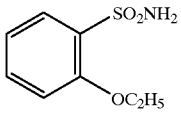

-continued (2-24)

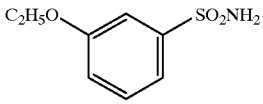

(2-25)

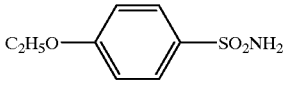

(2-26)

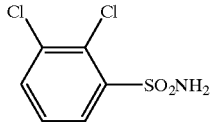

(2-27)

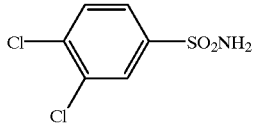

(2-28)

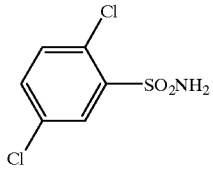

(2-29)

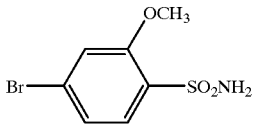

(2-30)

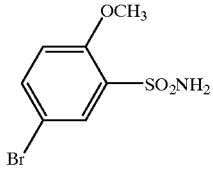

Further, in this invention, it is possible to use more than two kinds of compounds indicated by general formula (2) by mixing in molecular level. The mixing in molecular level of this invention, is different from the powder level mixing, that is, simply mixing of dispersion or mixing of powder at the preparation of dispersion. Namely, the mixture of molecular level of this invention is obtained by thermal fusion method, crystallization method of solution in which two compounds are dissolved, or by a method to crystallize the mixture after the synthesis of the compounds of general formula (2).

For example, the melting point of said (2-2) compound is 154–156° C. around, while the melting point of (2-4) compound is 136–138° C. around. And the melting point of molecular level mixture of said two compounds becomes lower by the eutectic effect, and excellent sensitizer effect can be obtained. The melting point alters by the mixing ratio of said two compounds, especially, mixing weight ratio of (2-2) and (2-4) is in the limit of 35:65–45:55, the melting point of these molecular level mixture drops to 100–110° C. around, and an excellent sensitizer effect can be obtained.

In the present invention, when the containing amount of compound indicated by general formula (2) is 0.01–2 parts to 1 part of color developer, the sufficient sensitivity effect and higher color developing density can be obtained, and is desirable.

Further, in this invention, it is possible to contain the compound indicated by general formula (3) in the thermally sensitive recording layer. If the compound indicated by general formula (3) is contained, the excellent color developing sensitivity can be obtained, for example by lower impressive energy than 0.2 mj/dot.

In the compound represented by general formula (3), $R_8$–$R_{13}$ can be a substituted group which does not hurt the sensitive effect, and as the concrete example, a hydrogen atom, an alkyl group, a halogen atom, a nitro group, an alkoxy group, a cyano group and an allyloxy group can be mentioned. As the concrete example of compound represented by general formula (3), compounds of (3-1)–(3-46) can be mentioned, however, not intended to be restricted to them. Among these compounds, (3-1) can be desirably used, because this compound displays good effect when it is used together with the color developer obtained in Synthetic Example (1).

(3-1)

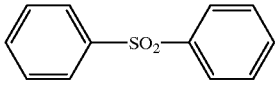

(3-2)

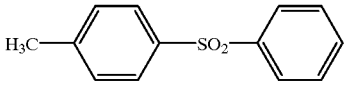

(3-3)

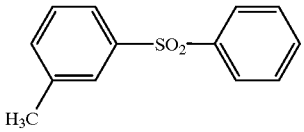

(3-4)

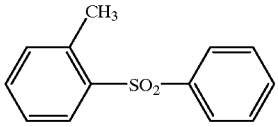

(3-5)

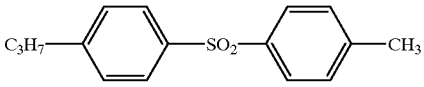

(3-6)

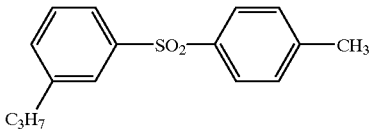

(3-7)

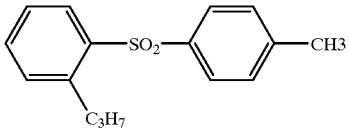

(3-8)

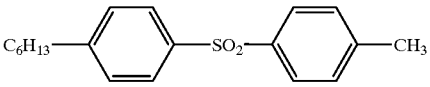

-continued (3-9)

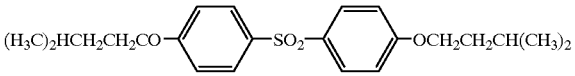

(3-10)

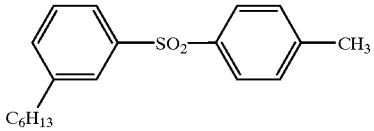

(3-11)

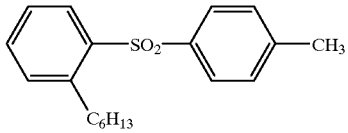

(3-12)

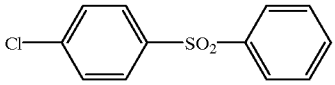

(3-13)

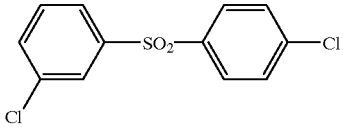

(3-14)

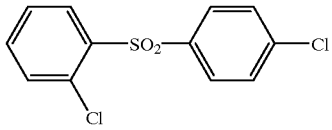

(3-15)

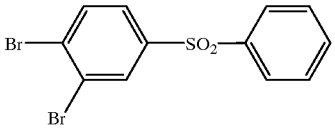

(3-16)

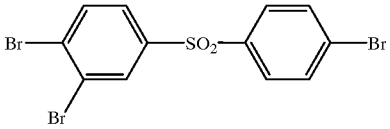

(3-17)

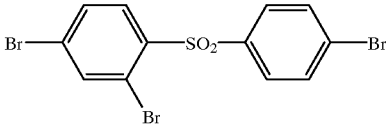

(3-18)

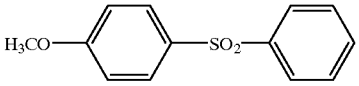

(3-19)

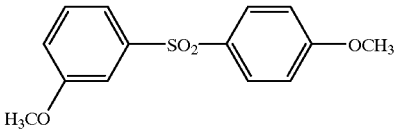

-continued
(3-20)
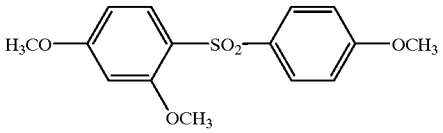
(3-21)
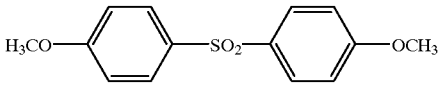
(3-22)
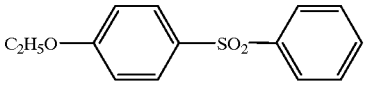
(3-23)
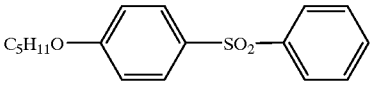
(3-24)
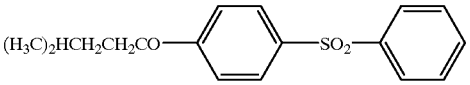
(3-25)
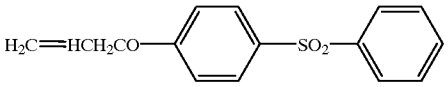
(3-26)
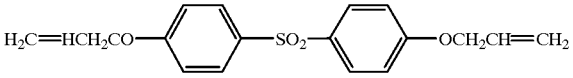
(3-27)
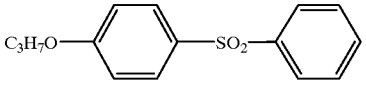
(3-28)
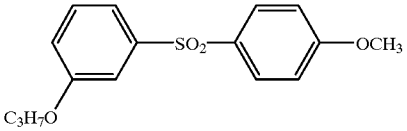
(3-29)
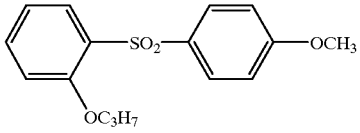
(3-30)
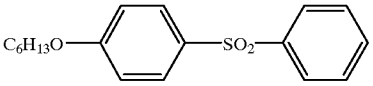
(3-31)
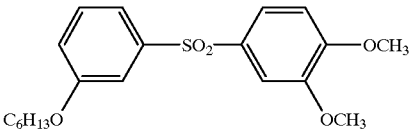
-continued
(3-32)
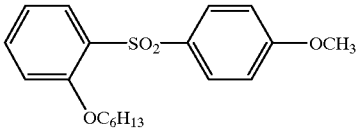
(3-33)
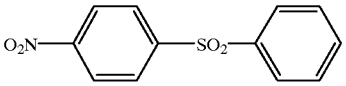
(3-34)
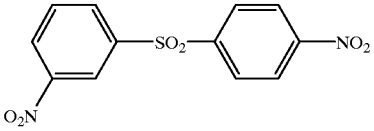
(3-35)
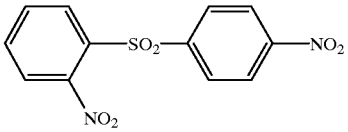
(3-36)
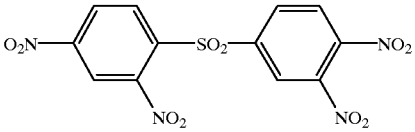
(3-37)
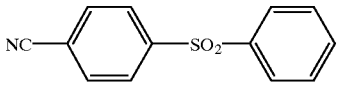
(3-38)
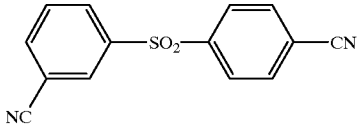
(3-39)
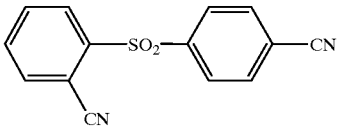
(3-40)
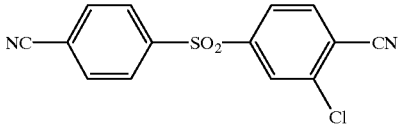
(3-41)
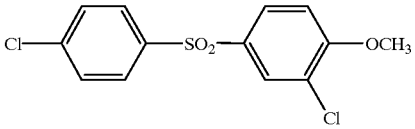
(3-42)
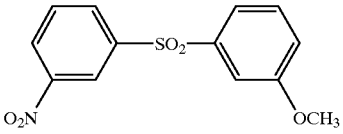

-continued (3-43)

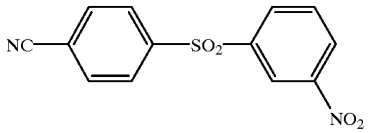

(3-44)

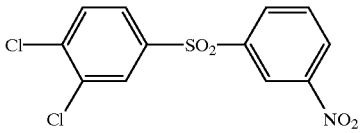

(3-45)

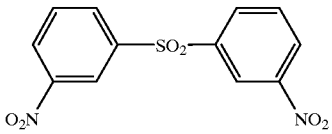

(3-46)

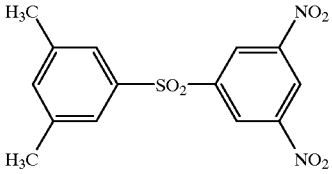

Further, in this invention, the compound represented by general formula (4) can be contained in the thermally sensitive recording layer. If the compound indicated by general formula (4) is contained, the heat resistance of ground color part is improved, and the recorded color stability such as resistance against plasticizer of image part is further improved.

In the compound represented by general formula (4), each substitution group can be a substituted group which does not hurt the sensitive effect, heat resistance of ground color and image stability and as the concrete example, an unsubstituted or substituted phenyl group, a naphtyl group, an aralkyl group, a lower alkyl group of carbon number 1–6, a cycloalkyl group of carbon number 3–6 or a lower alkenyl group of carbon number 2–6 can be mentioned as $R_{14}$, and a lower alkyl group of carbon number 1–6, or an electron attractive group such as fluorine, chlorine, bromine and a nitro group can be mentioned as W.

As the concrete example of compound represented by general formula (4), compounds of (4-1)–(4-72) can be mentioned, however, not intended to be restricted to them. Among these compounds, (4-10) can be desirably used, because this compound displays good effect when it is used together with the color developer obtained in Synthetic Example (1).

(4-1)

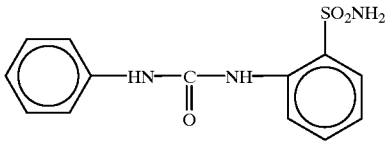

-continued (4-2)

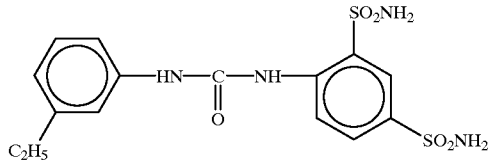

(4-3)

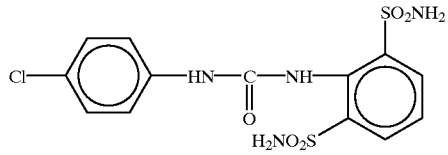

(4-4)

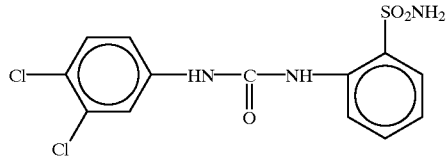

(4-5)

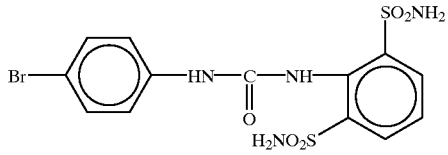

(4-6)

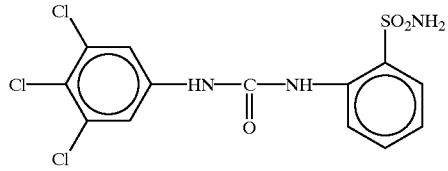

(4-7)

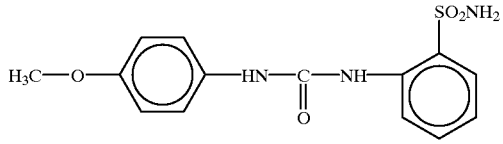

(4-8)

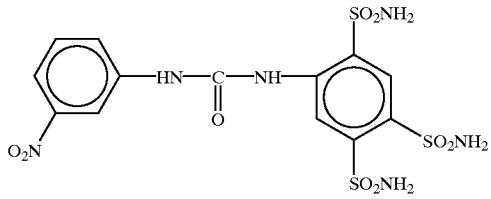

(4-9)

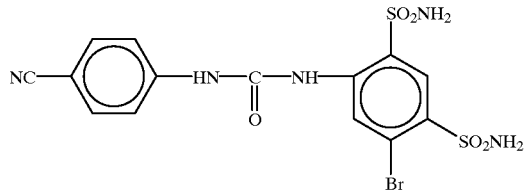

-continued
(4-10)
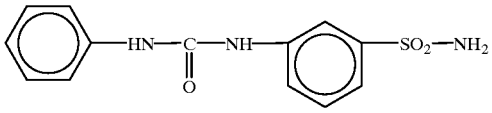
(4-11)
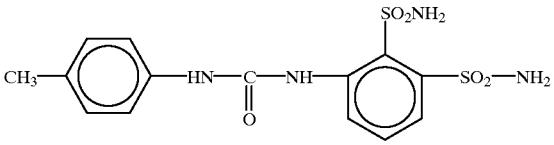
(4-12)
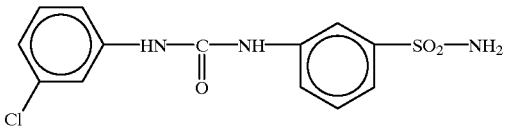
(4-13)
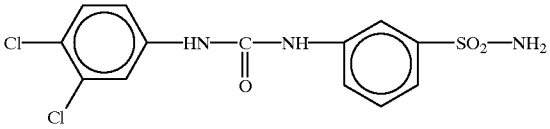
(4-14)
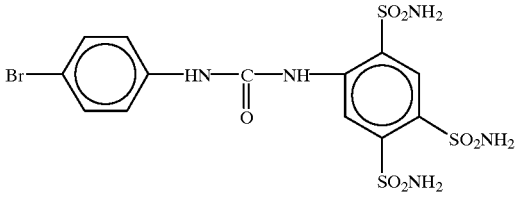
(4-15)
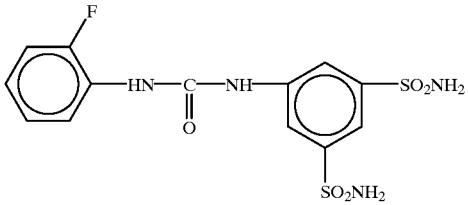
(4-16)
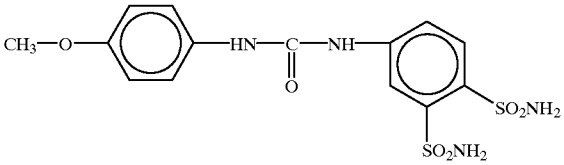
(4-17)
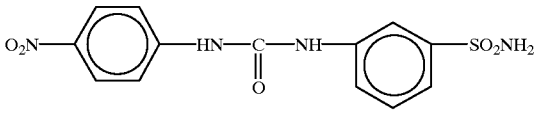
-continued
(4-18)
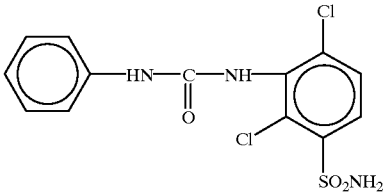
(4-19)
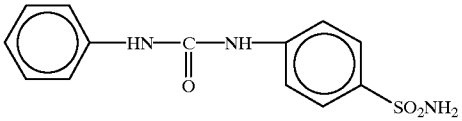
(4-20)
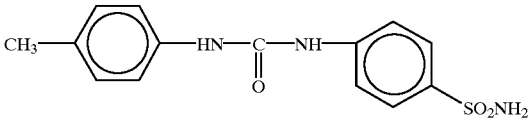
(4-21)
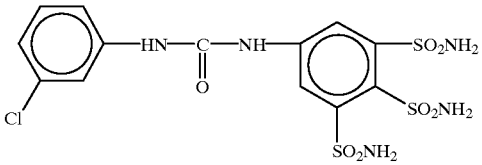
(4-22)
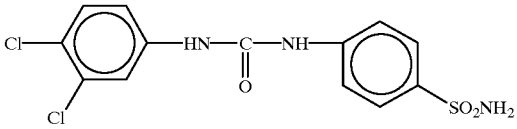
(4-23)
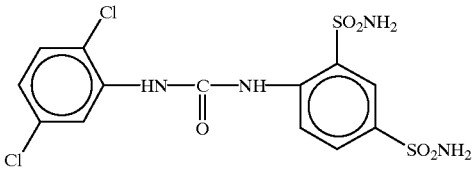
(4-24)
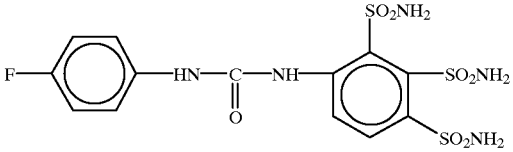
(4-25)
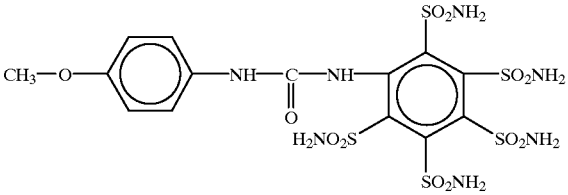

-continued
(4-26)
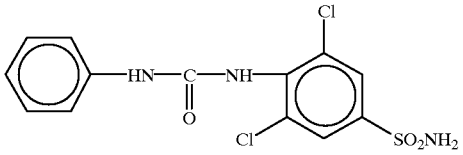
(4-27)
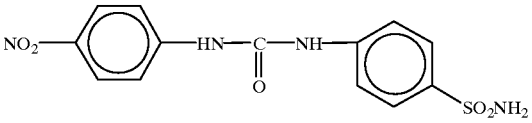
(4-28)
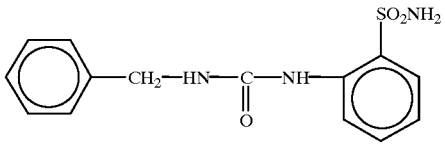
(4-29)
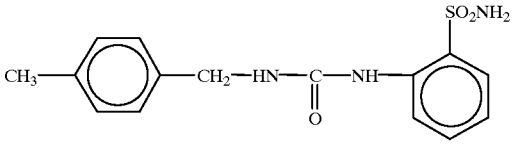
(4-30)
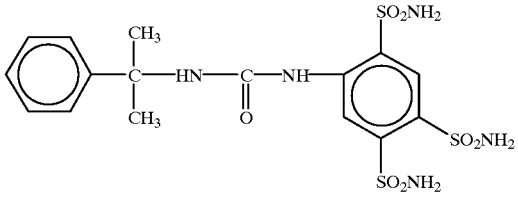
(4-31)
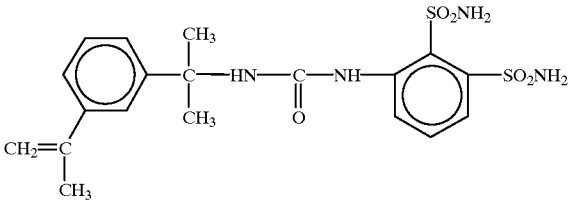
(4-32)
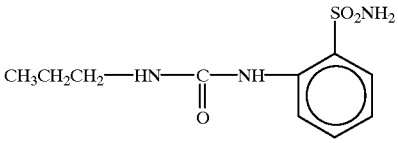
(4-33)
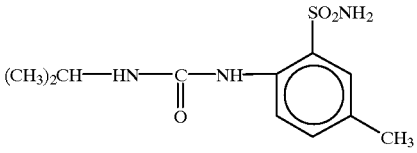
-continued
(4-34)
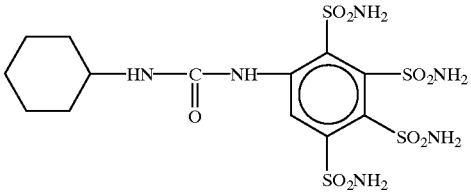
(4-35)
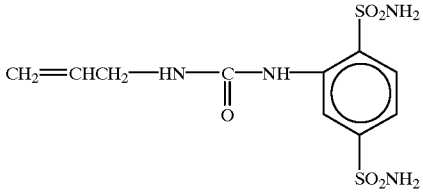
(4-36)
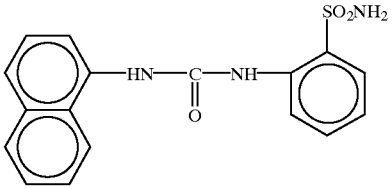
(4-37)
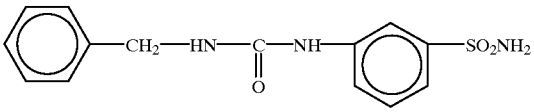
(4-38)
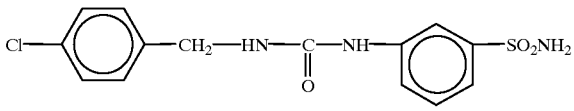
(4-39)
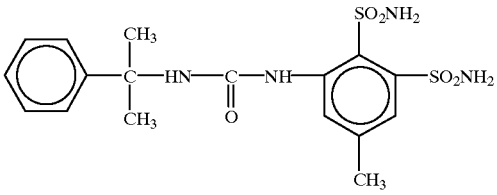
(4-40)
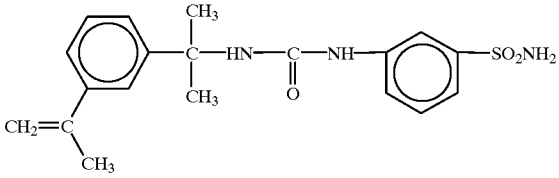

-continued
(4-41)
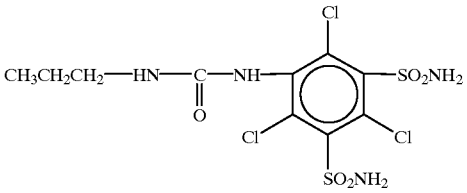
(4-42)
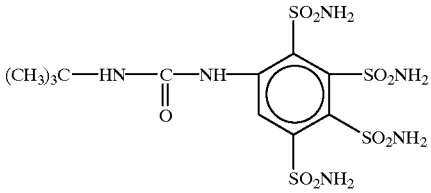
(4-43)
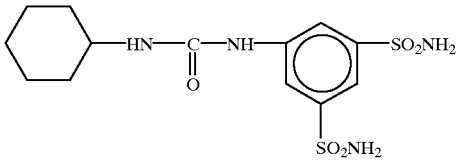
(4-44)
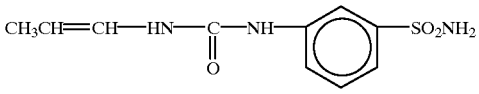
(4-45)
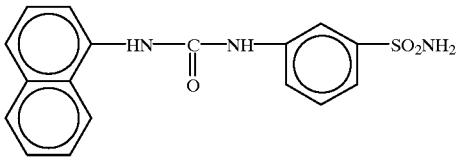
(4-46)
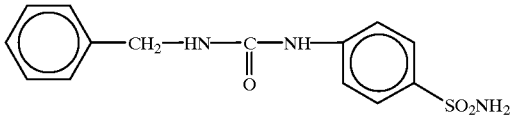
(4-47)
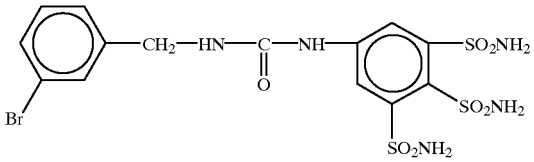
(4-48)
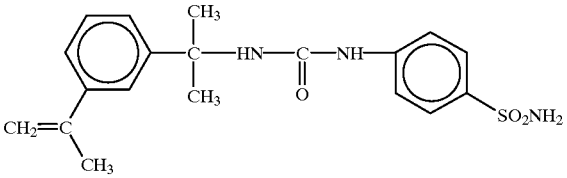
-continued
(4-49)
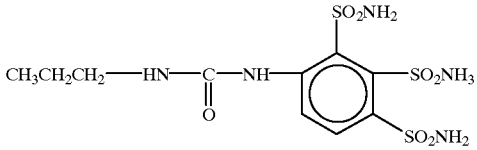
(4-50)
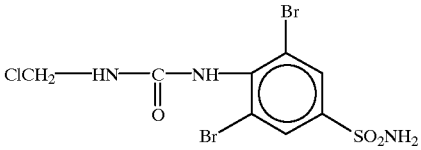
(4-51)
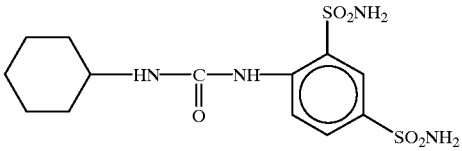
(4-52)
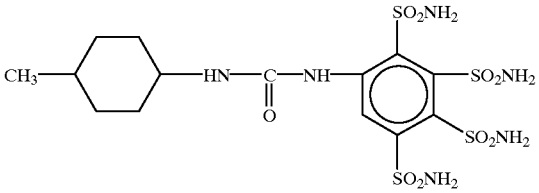
(4-53)
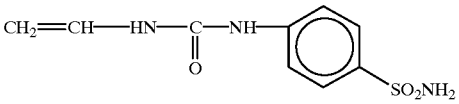
(4-54)
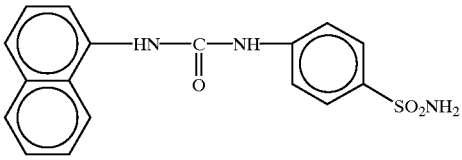
(4-55)
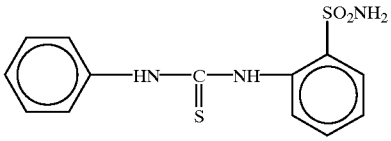
(4-56)
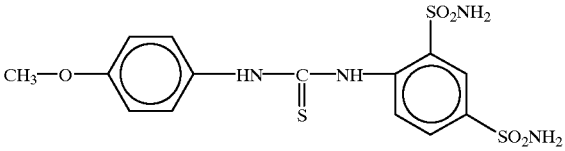

-continued
(4-57)
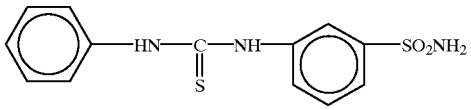
(4-58)
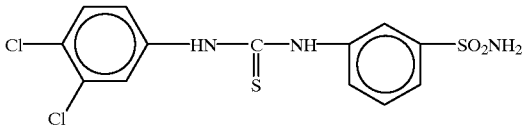
(4-59)
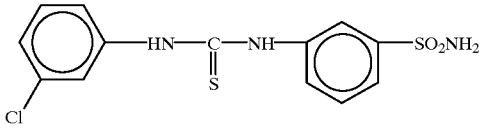
(4-60)
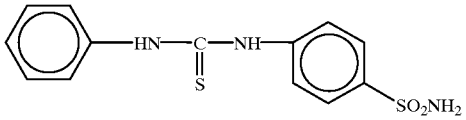
(4-61)
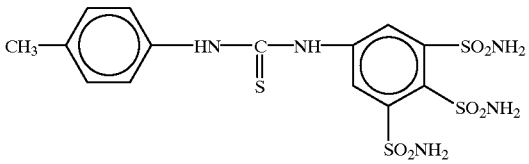
(4-62)
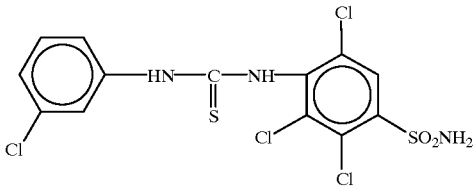
(4-63)
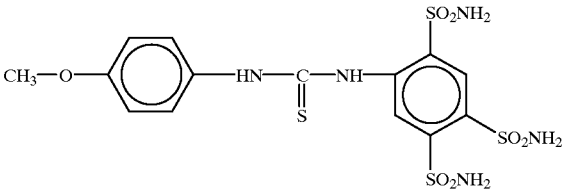
(4-64)
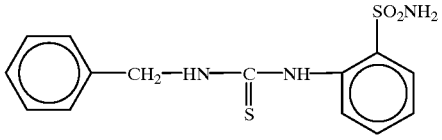
-continued
(4-65)
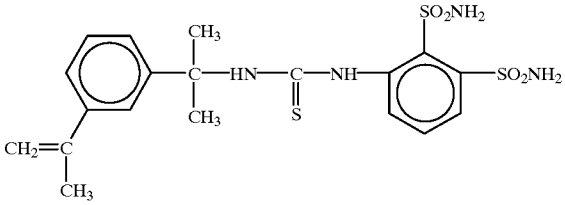
(4-66)
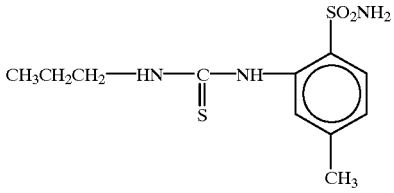
(4-67)
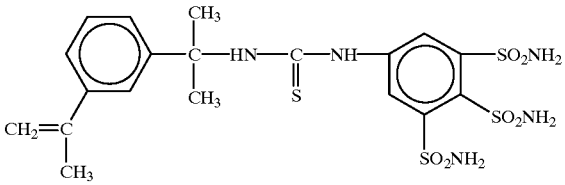
(4-68)
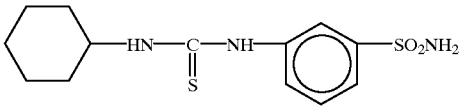
(4-69)
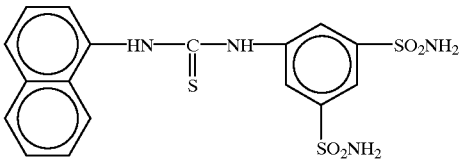
(4-70)
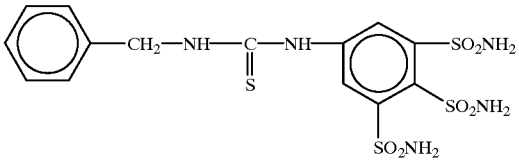
(4-71)
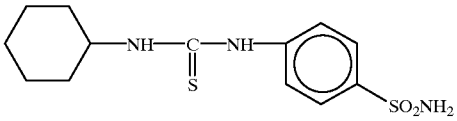
(4-72)
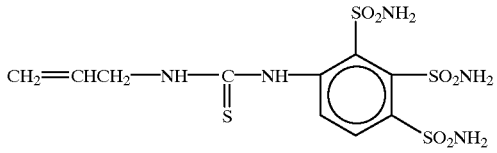

In this invention, the compound represented by general formula (5) can be contained in the thermally sensitive recording layer. If the compound indicated by general formula (5) is contained, the thermally sensitive recording medium which has good heat resistance of ground color part and image part, and has excellent color developing sensitivity can be obtained.

In the compound represented by general formula (5), $R_{15}$ can be a substituted group which does not hurt the sensitive effect, and as the concrete example, an unsabstituted or a substituted alkyl group of carbon number 1–4, and aralkyl group, a phenyl group or a hydrogen atom can be mentioned. As the concrete example of compound represented by general formula (5), compounds of (5-1)–(5-11) can be mentioned, however, not intended to be restricted to them. Among these compounds, (5-2) and (5-6) can be desirably used, because this compound displays good effect when it is used together with the color developer obtained in Synthetic Example (1).

(5-1)

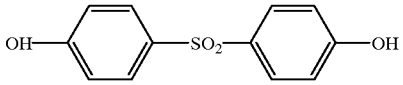

(5-2)

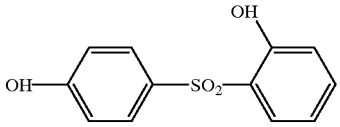

(5-3)

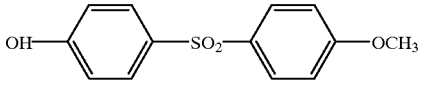

(5-4)

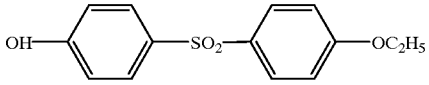

(5-5)

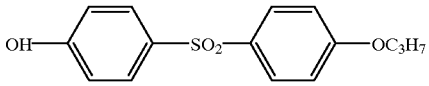

(5-6)

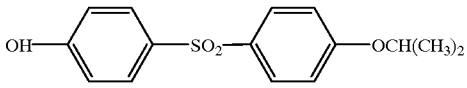

(5-7)

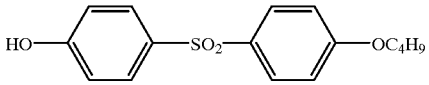

(5-8)

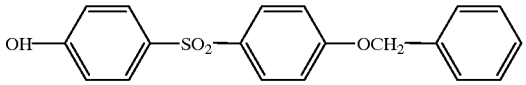

(5-9)

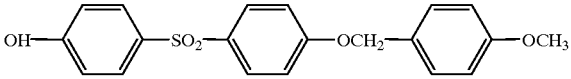

-continued (5-10)

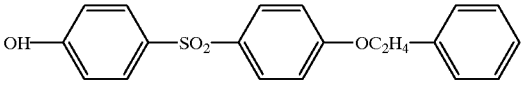

(5-11)

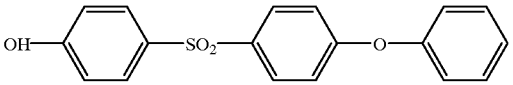

The desirable amount of compound represented by general formula (3), general formula (4) and general formula (5), to be contained in the thermally sensitive recording layer is 0.01–2 parts to 1 part of color developer. By said amount, sufficient sensitivity effect and high color developing density can be effectively obtained. Especially, regarding the compounds represented by general formula (4) and general formula (5), the desirable amount to be used is 0.01–0.9 parts to 1 part of color developer represented by general formula (1). In this invention, the reason why the color developing sensitivity is remarkably risen is not clearly clarified, however, it is considered that since the constitutional formula of these compounds are similar to that of color developer represented by general formula (1) or compounds represented by general formula (2), the compatibility is improved and an excellent sensitivity effect can be obtained.

DETAIL DESCRIPTION OF THE INVENTION

In general, a thermally sensitive recording medium is obtained by following procedure. Namely, a colorless or pale colored basic leuco dye and an organic color developer are dispersed together with binder, and additives such as a sensitizer, a filler, an ultra violet ray absorber, a water proof agent and a defoamer are added, and a coating is obtained. The obtained coating is coated on a substrate, thus a thermally sensitive recording medium is obtained.

As the colorless or pale colored basic leuco dye, the conventional well known dyes in the field of a pressure sensitive type or thermally sensitive recording paper can be used. Desirably, triphenyl methane type compound, fluorane type compound, fluorene type compound and divinyl type compound can be used, however, not intended to be limited to them. Typical example of colorless or pale colored leuco dye (dye precursor) are mentioned below. Further, these dye precursor can be used alone or together with.

<Triphenylmethane type leuco dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluorane type leuco dyes>

3-diethylamino-6-methylfluorane 3-diethylamino-6-methyl-7-anilinofluorane 3-diethylamino-6-methyl-7-(o,p-dimethylanilino)fluorane 3-diethylamino-6-methyl-7-chlorofluorane 3-diethylamino-6-methyl-7-(m-trifluoromethylanilino) fluorane 3-diethylamino-6-methyl-7-(o-chloroanilino)fluorane 3-diethylamino-6-methyl-7-(p-chloroanilino)fluorane 3-diethylamino-6-methyl-7-(o-fluoroanilino)fluorane 3-diethylamino-6-methyl-7-(m-methylanilino)fluorane
3-diethylamino-6-methyl-7-n-octylanilinofluorane
3-diethylamino-6-methyl-7-n-octylaminofluorane
3-diethylamino-6-methyl-7-benzylanilinofluorane
3-diethylamino-6-methyl-7-dibenzylanilinofluorane
3-diethylamino-6-chloro-7-methylfluorane
3-diethylamino-6-chloro-7-anilinofluorane
3-diethylamino-6-chloro-7-p-methylanilinofluorane
3-diethylamino-6-ethoxyethyl-7-anilinofluorane
3-diethylamino-7-methylfluorane
3-diethylamino-7-chlorofluorane
3-diethylamino-7-(m-trifluoromethylanilino)fluorane
3-diethylamino-7-(o-chloroanilino)fluorane
3-diethylamino-7-(p-chloroanilino)fluorane
3-diethylamino-7-(o-fluoroanilino)fluorane
3-diethylamino-benzo[a]fluorane
3-diethylamino-benzo[b]fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-chloroanilino)fluorane
3-dibutylamino-6-methyl-7-(p-chloroanilino)fluorane
3-dibutylamino-6-methyl-7-(o-fluoroanilino)fluorane
3-dibutylamino-6-methyl-7-(m-trifluoromethylanilino) fluorane
3-dibutylamino-6-methyl-chlorofluorane
3-dibutylamino-6-ethoxyethyl-7-anilinofluorane
3-dibutylamino-6-chloro-7-anilinofluorane
3-dibutylamino-6-methyl-7-p-methylanilinofluorane
3-dibutylamino-7-(o-chloroanilino)fluorane
3-dibutylamino-7-(o-fluoroanilino)fluorane
3-di-n-pentylamino-6-methyl-7-anilinofluorane
3-di-n-pentylamino-6-methyl-7-(p-chloroanilino)fluorane
3-di-n-pentylamino-7-(m-trifluoromethylaniliono)fluorane
3-di-n-pentylamino-6-chloro-7-anilinofluorane
3-di-n-pentylamino-7-(p-chloroanilino)fluorane
3-pyrrolidino-6-methyl-7-anilinofluorane
3-piperidino-6-methyl-7-anilinofluorane
3-(N-methyl-N-propylamino)-6-methyl-7-anilinofluorane
3-(N-methyl-N-cyclohexylamino)-6-methyl-7-anilinofluorane
3-(N-ethyl-N-cyclohexylamino)-6-methyl-7-anilinofluorane
3-(N-ethyl-N-xylamino)-6-methyl-7-(p-chloroanilino) fluorane
3-(N-ethyl-p-toluidino)-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-(N-ethyl-N-tetrahydrofurfurylamino)-6-methyl-7-anilinofluorane
3-(N-ethyl-N-isobutylamino)-6-methyl-7-anilinofluorane
3-(N-ethyl-N-ethoxypropylamino)-6-methyl-7-anilinofluorane
3-cyclohexylamino-6-chlorofluorane
2-(4-oxahexyl)-3-dimethylamino-6-methyl-7-anilinofluorane
2-(4-oxahexyl)-3-diethylamino-6-methyl-7-anilinofluorane
2-(4-oxahexyl)-3-dipropylamino-6-methyl-7-anilinofluorane
2-methyl-6-p-(p-dimethylaminophenyl) aminoanilinofluorane
2-methoxy-6-p-(p-dimethylaminophenyl) aminoanilinofluorane
2-chloro-3-methyl-6-p-(p-phenylaminophenyl) aminoanilinofluorane
2-chloro-6-p-(p-dimethylaminophenyl) aminoanilinofluorane
2-nitro-6-p-(p-diethylaminophenyl)aminoanilinofluorane
2-amino-6-p-(p-diethylaminophenyl)aminoanilinofluorane
2-diethylamino-6-p-(p-diethylaminophenyl) aminoanilinofluorane
2-phenyl-6-metyl-6-p-(p-phenylaminophenyl) aminoanilinofluorane
2-benzyl-6-p-(p-phenylaminophenyl)aminoanilinofluorane
2-hydroxy-6-p-(p-phenylaminophenyl) aminoanilinofluorane
3-methyl-6-p-(p-dimethylaminophenyl) aminoanilinofluorane
3-diethylamino-6-p-(p-diethylaminophenyl) aminoanilinofluorane
3-diethylamino-6-p-(p-dibutylaminophenyl) aminoanilinofluorane
2,4-dimethyl-6-[(4-dimethylamino)anilino]-fluorane <Fluorene type leuco dyes>

3,6,6'-tris(dimethylamino)spiro[fluorene-9,3'-phthalide]
3,6,6'-tris(diethylamino)spiro[fluorene-9,3'-phthalide]

<Divinyl type leuco dyes>

3,3-bis-[2-(p-dimethylaminophenyl)-2-(p-methoxyphenyl) ethenyl]-4,5,6,7-tetrabromophthalide
3,3-bis-[2-(p-dimethylaminophenyl)-2-(p-methoxyphenyl) ethenyl-4,5,6,7-tetrachlorophthalide
3,3-bis-[1,1-bis(4-pyrrolidinophenyl)ethylen-2-yl]-4,5,6,7-tetrabromophthalide
3,3-bis-[1-(4-methoxyphenyl)-1-(4-pyrrolidinophenyl) ethylene-2-yl]-4,5,6,7-tetrachlorophthalide <Others>

3-(4-diethylamino-2-ethoxyphenyl)-3-(1-ethyl-2-methylindol-3-yl)-4-azaphthalide.
3-(4-diethylamino-2-ethoxyphenyl)-3-(1-octyl-2-methylindol-3-yl)-4-azaphthalide
3-(4-cyclohexylethylamino-2-methoxyphenyl)-3-(1-ethyl-2-methylindol-3-yl)-4-azaphthalide
3,3-bis(1-ethyl-2-methylindol-3-yl)phthalide
3,6-bis(diethylamino)fluorane-γ-(3'-nitro)anilinolactam
3,6-bis(diethylamino)fluorane-γ-(4'-nitro)anilinolactam
1,1-bis-[2',2',2",2"-tetrakis-(p-dimethylaminophenyl)-ethenyl]-2,2-dinitrilethane
1,1-bis-[2',2',2",2"-tetrakis-(p-dimethylaminophenyl)-ethenyl]-2-β-naphthoyl ethane
1,1-bis-[2',2',2",2"-tetrakis-(p-dimethylaminophenyl)-ethenyl]-2,2-diacetylethane
bis-[2,2,2',2'-tetrakis-(p-dimethylaminophenyl)-ethenyl]-methylmalonicacid dimethyl ester.

In this invention, the well known color developer which develops the color of colorless or pale colored basic leuco dye can be used together with in the limitation not to hurt the desirable effect to said object. In the case of color developer, the desirable amount to be added is small, and concrete amount of conventional well known color developer is 0.09–0.9 parts around to the compound represented by general formula (1). As the concrete example of said color developer, for instance, bisphenol A type disclosed in Japanese Patent Laid Open Publication 3-207688 and Japanese Patent Laid Open Publication 5-24366, 4-hydroxybenzoic acid ester type, 4-hydroxyphtalic acid diester type, phtalic acid monoester type, bis-(hydroxyphenyl)sulfide type, 4-hydroxyphenylarylsulphonate type, 1,3-di[hydroxyphenyl]-2-propyl]-benzene type and 4-hydroxybenzoyloxybenzoic acid ester type can be mentioned.

In this invention, the well known sensitized can be used in the limitation not to hurt the desirable effect to said object. As the concrete example, fatty acid amide such as stearic acid amide or palmitic acid, ethylenebisamide, montan acid wax, polyethylene wax, 1,2-di-(3-methylphenoxy)ethane, p-benzilbiphenyl, β-benziloxynaphthalene, 4-biphenyl-p-tolylether, m-tarphenyl, 1,2-diphenoxyethane, dibenzyl 4,4'-ethylenedioxy-bis-benzoate, dibenzoyloxymethane, 1,2-di (3-methylphenoxy)ethylene, 1,2-diphenoxyethylene, bis[2-(4-methoxyphenoxy)]ethyl]ether, p-nitro methyl benzoate, dibenzyl oxalate, di(p-chloro benzyl) oxalate, di(p-methyl benzyl) oxalate, dibenzylterephthalate, benzyl p-benzyloxybenzoate, di-p-tolyl carbonate, phenyl-α-naphthylcarbonate, 1,4-diethoxy naphthalene, phenyl 1-hydroxy-2-naphthoate, o-xylene-bis-(phenylether) and 4-(m-methylphenoxy methyl)biphenyl can be mentioned, however, not intended to be limited to them. These sensitizer can be used alone or used together with.

As the binder to be used in the present invention, full saponificated polyvinyl alcohol of 200~1900 polymerization degree, partial saponificated polyvinyl alcohol, denatured polyvinyl alcohol by carboxyl, denatured polyvinyl alcohol by amide denatured polyvinyl alcohol by sulfonic acid denatured polyvinyl alcohol by butylal modified polyvinyl alcohol, derivatives of cellulose such as hydroxyethyl cellulose, methyl cellulose, ethyl cellulose, carboxymethyl cellulose and acetyl cellulose, copolymer of styrene-maleic unhydride, copolymer of styrene-butadiene, polyvinyl chloride, polyvinyl acetal, polyacrylicamide, polyacrylic acid ester, polyvinylbutylal, polystyrene or copolymer of them, polyamide resin, silicon resin, petroleum resin, terpene resin, ketone resin and cumarone resin can be illustrated. These macro molecule compounds can be applied by being dissolved into solvents such as water, alcohol, ketone, ester or hydrocarbon or by being dispersed in water or other medium under an emulsion state or a paste state and these forms of application can be used in combination according to the quality requirement.

And in this invention, as the image stabilized which improve the resistance effect against oil of recorded image, 4,4'-buthylidene(6-t-buthyl-3-methylphenol),
2,2'-di-t-buthyl-5,5'-dimethyl-4,4'-sulphonyldiphenol,
1,1,3,-tris(2-methyl-4-hydroxy-5-cyclohexylphenyl) buthane and
1,1,3,-tris(2-methyl-4-hydroxy-5-t-buthylphenyl)buthane can be added in the limit not to hurt above mentioned desired effect.

As a filler which can be used in this invention, an inorganic or an organic filler such as silica, calcium carbonate, kaoline, calcined kaoline, diatomaceous earth, talc, titanium oxide, zinc oxide or aluminum hydroxide can be mentioned.

Further, a parting agent such as metallic salt of fatty acid, a slipping agent such as wax, benzophenon type or triazole type ultraviolet absorbers, water proof agent such as glyoxal, dispersing agent, defoamer anti-oxidation agent and fluorescent dye can be used as an additive.

The amount of color developer and dye precursor, the kind and amount of other additives to be used to the thermally sensitive recording medium of this invention are decided according to the required quality and recording feature, and not restricted. However, in general, it is preferable to use 0.1–2 parts of basic leuco dye, 0.01–2 parts of compound indicated by general formula (2) and 0.5–4 parts of filler to 1 part of color developer indicated by general formula (1) are used. And the desirable amount of binder is 5~25% to the total amount of solid.

The coating of above mentioned component is coated over the surface of substrate such as paper, synthetic paper, film or plastic, and the desired thermally sensitive recording medium can be obtained. Further, to improve the preservative property, an overcoat layer can be prepared on the thermally sensitive color developing layer. Said organic color developer, basic leuco dye and other additives which are added at need are ground to the fine particles smaller than several microns diameter by means of a pulverizer such as a ball mill, an attriter or a sand grinder, or by means of an adequate emulsifying apparatus, then binder and other additives are added at need, thus the coating is prepared. Further, to improve the color sensitivity, an undercoat layer of polymer containing filler can be formed under the thermally sensitive layer.

EXAMPLE

The thermally sensitive recording medium of this invention will be illustrated more concretely by Examples, however, not intended to be limited by them. In the Examples and Comparative Examples, "parts" and "%" indicate by weight.

Example 1–4

Examples 1–4 are the examples which use compound (1-1), (1-2), (1-13) or (1-17) as a color developer, 3-dibuthylamino-6-methyl-7-anilinofluorane (ODB-2) as a basic leuco dye and compound (2-2) as the compound indicated by general formula (2) (hereinafter shortened to sensitizer).

Dispersion of color developer (A solution), dispersion of basic leuco dye (B solution) and dispersion of sensitizer (C solution) are separately ground in wet condition to average particle diameter of 1 μm by a sand grinder.

| | |
|---|---|
| A solution (dispersion of color developer) | |
| color developer | 6.0 parts |
| 10% aqueous solution of polyvinyl alcohol | 18.8 parts |
| water | 11.2 parts |
| B solution (dispersion of basic leuco dye) | |
| 3-dibutylamino-6-methyl-7-anilinofluorane [ODB-] | 2.0 parts |
| 10% aqueous solution of polyvinyl alcohol | 4.6 parts |
| water | 2.6 parts |
| C solution (dispersion of sensitizer) | |
| compound (2-2) | 4.0 parts |
| 10% aqueous solution of polyvinyl alcohol | 18.8 parts |
| water | 11.2 parts |
| These dispersions are mixed by following ratio and the coating is prepared. | |
| A solution (dispersion of color developer) | 36.0 parts |
| B solution (dispersion of basic leuco dye [ODB-2]) | 9.2 parts |
| C solution (dispersion of sensitizer [compound (2-2)] | 34.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 5

In Example 5, a compound obtained by Synthetic Example 1 is used as a color developer and compound (2-2) is used as a sensitizer.

According to Examples 1–4, dispersion of basic leuco dye and dispersion of sensitizer is treated. Dispersion of color developer (D solution) obtained by Synthetic Example 1 is ground in wet condition to average particle diameter of 1 μm by a sand grinder.

| D solution (dispersion of color developer obtained by Synthetic Example 1) | |
|---|---|
| afore mentioned color developer | 6.0 parts |
| 10% aqueous solution of polyvinyl alcohol | 18.8 parts |
| water | 11.2 parts |
| These dispersions are mixed by following ratio and the coating is prepared. | |
| D solution (dispersion of color developer obtained by Synthetic Example 1) | 36.0 parts |
| B solution (dispersion of basic leuco dye [ODB-2]) | 9.2 parts |
| C solution (dispersion of sensitizer [compound (2-2)]) | 34.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 6

Same dispersion of sensitizer to Example 5 is used and the blending ratio is changed to 85.0 parts, and by same procedure to Example 5, the thermally sensitive recording medium is obtained.

Example 7–10

In Example 7–10, a compound obtained by Synthetic Example 2–5 are used as a color developer and compound (2-2) is used as a sensitizer.

According to Examples 1–4, dispersion of basic leuco dye and dispersion of sensitizer is treated. Dispersion of color developer (E solution) obtained by Synthetic Example 2–5 are ground separately in wet condition to average particle diameter of 1 μm by a sand grinder.

| E solution (dispersion of color developer obtained by Synthetic Example 2–5) | |
|---|---|
| afore mentioned color developer | 6.0 parts |
| 10% aqueous solution of polyvinyl alcohol | 18.8 parts |
| water | 11.2 parts |
| These dispersions are mixed by following ratio stirred and the coating is prepared. | |
| E solution (dispersion of color developer obtained by Synthetic Example 2–5) | 36.0 parts |
| B solution (dispersion of basic leuco dye [ODB-2)]) | 9.2 parts |
| C solution (dispersion of sensitizer [compound (2-2)]) | 34.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0g/m$^2$ coating amount is obtained.

Example 11–13

In Example 11–13, a compound obtained by Synthetic Example 1 is used as a color developer, not ODB-2 basic leuco dye mentioned below are used and compound (2-2) is used as a sensitizer.

(Basic Leuco Dye)

ODB: 3-diethylamino-6-methyl-7-anilinofuruorane

S-205: 3-(N-ethyl-N-isoamylamino)-6-methyl-7-anilinofuruorane

Black-100: 3-diethylamino-7-(m-trifluoromethylanilino) fluorane

According to Examples 1–4, dispersion of color developer obtained by Synthetic Example 1 and dispersion of sensitizer is treated. Dispersion of basic leuco dye except ODB-2 (F solution) are ground separately in wet condition to average particle diameter of 1 μm by a sand grinder.

| F solution (dispersion of basic leuco dye except ODB-2) | |
|---|---|
| afore mentioned color developer | 2.0 parts |
| 10% aqueous solution of polyvinyl alcohol | 4.6 parts |
| water | 2.6 parts |
| These dispersions are mixed by following ratio stirred and the coating is prepared. | |
| D solution (dispersion of color developer obtained by Synthetic Example 1) | 36.0 parts |
| F solution (dispersion of basic leuco dye except [ODB-2]) | 9.2 parts |
| C solution (dispersion of sensitizer [compound (2-2)] | 34.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 14, 15

In Example 14 and 15, a compound obtained by Synthetic Example 1 is used as a color developer, ODB-2 is used as a basic leuco dye and compounds (2-4) and (2-7) are used as a sensitizer.

According to Examples 1–4, dispersion of compound of color developer obtained by Synthetic Example 1 and dispersion of ODB-2 are treated. And dispersion of compounds of (2-4) and (2-7) (G solution) are prepared by same procedure to compound (2-2).

These dispersions are mixed by following ratio stirred and the coating is prepared.

| D solution (dispersion of color developer obtained by Synthetic Example 1) | 36.0 parts |
|---|---|
| B solution (dispersion of basic leuco dye [ODB-2]) | 9.2 parts |
| G solution (dispersion of sensitizer) | 34.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 16

In Example 16, a compound obtained by Synthetic Example 1 is used as a color developer, ODB-2 and S-205 are used as a basic leuco dye and compounds (2-2) is used as a sensitizer.

According to Examples 1–4, dispersion of compound of color developer obtained by Synthetic Example 1 and dispersion of OBD-2 and S-205 and dispersion of compound (2-2) sensitizer are treated.

These dispersions are mixed by following ratio, stirred and the coating is prepared.

| | |
|---|---|
| D solution (dispersion of color developer obtained by Synthetic Example 1) | 36.0 parts |
| B solution (dispersion of basic leuco dye [OBD-2]) | 4.6 parts |
| F solution (dispersion of basic leuco dye [S-205]) | 4.6 parts |
| C solution (dispersion of sensitizer [compound (2-2)]) | 34.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 17

In Example 17 a compound obtained by Synthetic Example 1 is used as a color developer, ODB-2 is used as a basic leuco dye and compounds (2-2) and (2-4) are used as a sensitizer.

According to Examples 1–4, dispersion of compound of color developer obtained by Synthetic Example 1 and dispersion of ODB-2 and dispersion of compound (2-2) and (2-4) sensitizer are treated.

These dispersions are mixed by following ratio, stirred and the coating is prepared.

| | |
|---|---|
| D solution (dispersion of color developer obtained by Synthetic Example 1) | 36.0 parts |
| B solution (dispersion of basic leuco dye [ODB-2]) | 9.2 parts |
| C solution (dispersion of sensitizer [compound (2-2)]) | 13.6 parts |
| G solution (dispersion of sensitizer [compound (2-4)]) | 20.4 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 18

In Example 18 a compound obtained by Synthetic Example 1 is used as a color developer, ODB-2 is used as a basic leuco dye and compounds (2-2) and (2-4) are used as a sensitizer, and (2-2) and (2-4) are mixed by molecular level.

The mixture of (2-2) and (2-4) of following ratio is heated and fused homogeneously and cooled down to the room temperature and solidified. Then granulated and the molecular level mixture of (2-2) and (2-4) whose weight ratio is 40:60 is obtained (S-1). The starting point for melting of this molecular level mixture is higher than 103° C.

| | |
|---|---|
| compound (2-2) | 1.6 parts |
| compound (2-4) | 2.4 parts |

According to Examples 1–4, dispersion of compound of color developer obtained by Synthetic Example 1 and dispersion of ODB-2 are treated, and dispersion of mixture (S-1) is prepared (H solution) is prepared by same procedure to compound (2-2).

| H solution (dispersion of sensitizer) | |
|---|---|
| mixture (S-1) | 4.0 parts |
| 10% aqueous solution of polyvinyl alcohol | 18.8 parts |
| water | 11.2 parts |
| These dispersions are mixed by following ratio, stirred and the coating is prepared. | |
| D solution (dispersion of color developer obtained by Synthetic Example 1) | 36.0 parts |
| B solution (dispersion of basic leuco dye [ODB-2]) | 9.2 parts |
| H solution (dispersion of sensitizer [compound (2-2)]) | 34.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 19–21

In Example 19–21 a compound obtained by Synthetic Example 1 is used as a color developer, ODB-2 is used as a basic leuco dye and compounds (2-2), (3-1), (3-9) and (3-26) are used as a sensitizer.

According to Examples 1–4, dispersion of compound of color developer obtained by Synthetic Example 1 and dispersion of dye and dispersion of compound (2-2) sensitizer are treated. Dispersion of compounds (3-1), (3-9) and (3-26) (I solution) are ground separately in wet condition to average particle diameter of 1 $\mu$m by a sand grinder.

| I solution (dispersion of sensitizer) | |
|---|---|
| afore mentioned compound | 4.0 parts |
| 10% aqueous solution of polyvinyl alcohol | 18.8 parts |
| water | 11.2 parts |
| These dispersions are mixed by following ratio, stirred and the coating is prepared. | |
| D solution (dispersion of color developer obtained by Synthetic Example 1) | 36.0 parts |
| B solution (dispersion of basic leuco dye [ODB-2]) | 9.2 parts |
| C solution (dispersion of sensitizer [compound (2-2)]) | 34.0 parts |
| I solution (dispersion of compound) | 34.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 22

In Example 22 a compound obtained by Synthetic Example 1 is used as a color developer, ODB-2 is used as a basic leuco dye and compounds (2-2) and (4-10) are used as a sensitizer.

According to Examples 1–4, dispersion of compound of color developer obtained by Synthetic Example 1 and dispersion of dye and dispersion of compound (2-2) sensitizer are treated. Dispersion of compounds (4-10), (J solution) are ground in wet condition to average particle diameter of 1 μm by a sand grinder.

| J solution | |
|---|---|
| afore mentioned compound | 2.0 parts |
| 10% aqueous solution of polyvinyl alcohol | 6.3 parts |
| water | 3.7 parts |
| These dispersions are mixed by following ratio, stirred and the coating is prepared. | |
| D solution (dispersion of color developer obtained by Synthetic Example 1) | 36.0 parts |
| B solution (dispersion of basic leuco dye [ODB-2]) | 9.2 parts |
| C solution (dispersion of sensitizer [compound (2-2)] | 34.0 parts |
| J solution (dispersion of compound) | 12.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Example 23

The thermally sensitive recording medium is prepared using same dispersion of sensitizer used in Example 22 by same procedure to Example 22 except the blending amount of it is 85.0 parts.

Example 24

The thermally sensitive recording medium is prepared using same dispersion of sensitizer used in Example 22 by same procedure to Example 22 except the blending amount of it is 48.0 parts.

Example 25–28

According to Examples 1–4, dispersion of compound of color developer obtained by Synthetic Example 1 and dispersion of dye and dispersion of compound (2-2) sensitizer are treated. Dispersion of compounds (5-2), (5-1), (5-5) and (5-6) solution) are ground separately in wet condition to average particle diameter of 1 μm by a sand grinder.

| K solution | |
|---|---|
| afore mentioned compound | 2.0 parts |
| 10% aqueous solution of polyvinyl alcohol | 6.3 parts |
| water | 3.7 parts |
| These dispersions are mixed by following ratio, stirred and the coating is prepared. | |
| D solution (dispersion of color developer obtained by Synthetic Example 1) | 36.0 parts |

-continued

| | |
|---|---|
| B solution (dispersion of basic leuco dye [ODB-2]) | 9.2 parts |
| C solution (dispersion of sensitizer [compound (2-2)] | 34.0 parts |
| K solution (dispersion of compound) | 12.0 parts |
| kaolin clay (50% dispersion) | 12.0 parts |

The prepared coating for thermally sensitive recording layer is coated over the one side surface of 50 g/m$^2$ substrate paper and dried up, and the obtained sheet is treated by a super calendar so as the smoothness become 500–600 sec. and the thermally sensitive recording medium of 6.0 g/m$^2$ coating amount is obtained.

Comparative Example 1

The procedure same as to Example 5 is carried out. At the forming of color developing layer, C dispersion is not mixed.

Comparative Example 2

The procedure same as to Example 5 is carried out. At the preparation of dispersion C, p-benzylbiphenyl (PBB) is used instead of compound (2-2).

Comparative Example 3, 4

In Comparative Example 3, 4, the color developer of Example 5 is replaced to the color developer mentioned below. Comparative Example 3: 4,4'-isopropyridenediphenol (shortened to BPA) Comparative Example 4: 4'-hydroxy-4'-isopropoxydiphenylsulfone (shortened to D-8)

Comparative Example 5

The procedure same as to Example 19 is carried out. At the preparation of dispersion C, p-benzylbiphenyl (PBB) is used instead of compound (2-2).

<Evaluation of Thermal Recording Property>

Thermal recording was carried out on the prepared thermally sensitive recording media using TH-PMD (thermally sensitive printer in which thermal head is installed, product of Kyocera Co., Ltd.) by 0.30 and 0.38 mj/dot impressive energy. Recording density of the recorded portion is measured by means of a Macbeth densitometer (RD-914, amber filter used) (refer to Table 1 and Table 2).

<Evaluation of Resistance for Plasticizer >

A single sheet of polyvinylchloride wrap (HIGHWRAP KMA: Mitsui Toatsu Chemicals Co., Ltd.) was wound round with 1 plie on a paper tube, stuck thereon a thermal recording medium recorded by the above mentioned printer (0.38 mj/dot), further wound round with 3 plies of the polyvinylchloride wrap, allowed to stand at 40° C. for 24 hours, and measured the Macbeth density of the recorded part and ground part (refer to Table 1 and Table 2).

TABLE 1

| Example Co. Ex. | color developer | dye | compound of (2) | compound of (3),(4),(5) |
|---|---|---|---|---|
| Ex. 1 | comp. (1-1) | ODB-2 | comp. (2-2) (0.67) | |
| Ex. 2 | comp. (1-2) | ODB-2 | comp. (2-2) (0.67) | |
| Ex. 3 | comp. (1-13) | ODB-2 | comp. (2-2) (0.67) | |
| Ex. 4 | comp. (1-17) | ODB-2 | comp. (2-2) (0.67) | |
| Ex. 5 | Syn. Ex. 1 | ODB-2 | comp. (2-2) (0.67) | |
| Ex. 6 | Syn. Ex. 1 | ODB-2 | comp. (2-2) (1.67) | |

TABLE 1-continued

| Example Co. Ex. | color developer | dye | compound of (2) | compound of (3),(4),(5) |
|---|---|---|---|---|
| Ex. 7 | Syn. Ex. 1 | ODB-2 | comp. (2-2) (0.67) | |
| Ex. 8 | Syn. Ex. 3 | ODB-2 | comp. (2-2) (0.67) | |
| Ex. 9 | Syn. Ex. 4 | ODB-2 | comp. (2-2) (0.67) | |
| Ex. 10 | Syn. Ex. 5 | ODB-2 | comp. (2-2) (0.67) | |
| Ex. 11 | Syn. Ex. 1 | ODB | comp. (2-2) (0.67) | |
| Ex. 12 | Syn. Ex. 1 | S-205 | comp. (2-2) (0.67) | |
| Ex. 13 | Syn. Ex. 1 | Black-100 | comp. (2-2) (0.67) | |
| Ex. 14 | Syn. Ex. 1 | ODB-2 | comp. (2-4) (0.67) | |
| Ex. 15 | Syn. Ex. 1 | ODB-2 | comp. (2-7) (0.67) | |
| Ex. 16 | Syn. Ex. 1 | ODB-2<br>S-205 | comp. (2-2) (0.67) | |
| Ex. 17 | Syn. Ex. 1 | ODB-2 | comp. (2-2) (0.27)<br>comp. (2-4) (0.40) | |
| Ex. 18 | Syn. Ex. 1 | ODB-2 | mixt. (S-1) (0.67) | |
| Ex. 19 | Syn. Ex. 1 | ODB-2 | comp. (2-2) (0.67) | comp. (3-1) (0.67) |
| Ex. 20 | Syn. Ex. 1 | ODB-2 | comp. (2-2) (0.67) | comp. (3-9) (0.67) |
| Ex. 21 | Syn. Ex. 1 | ODB-2 | comp. (2-2) (0.67) | comp. (3-26) (0.67) |
| Ex. 22 | Syn. Ex. 1 | ODB-2 | comp. (2-2) (0.67) | comp. (4-10) (0.33) |
| Ex. 23 | Syn. Ex. 1 | ODB-2 | comp. (2-2) (1.67) | comp. (4-10) (0.67) |
| Ex. 24 | Syn. Ex. 1 | ODB-2 | comp. (2-2) (0.67) | comp. (4-10) (1.33) |
| Ex. 25 | Syn. Ex. 1 | ODB-2 | comp. (2-2) (0.67) | comp. (5-2) (0.33) |
| Ex. 26 | Syn. Ex. 1 | ODB-2 | comp. (2-2) (0.67) | comp. (5-1) (0.33) |
| Ex. 27 | Syn. Ex. 1 | ODB-2 | comp. (2-2) (0.67) | comp. (5-5) (0.33) |
| Ex. 28 | Syn. Ex. 1 | ODB-2 | comp. (2-2) (0.67) | comp. (5-6) (0.33) |
| Co. Ex. 1 | Syn. Ex. 1 | ODB-2 | — | |
| Co. Ex. 2 | Syn. Ex. 1 | ODB-2 | PBB | |
| Co. Ex. 3 | BPA | ODB-2 | comp. (2-2) | |
| Co. Ex. 4 | D-8 | ODB-2 | comp. (2-2) | |
| Co. Ex. 5 | Syn. Ex. 1 | ODB-2 | PBB | comp. (3-1) |

Remarks
:in the column of compound of general formula (2), (3), (4) and (5), numerical value in parenthesis is weight part to 1 part of color developer
:Co. Ex. means Comparative Example
:Syn. Ex. means Synthetic Example
:mixt. means mixture

TABLE 2

| Example | Recording density | | recording density |
|---|---|---|---|
| Co. Ex. | 0.30 mj/dot | 0.38 mj/dot | after test |
| Ex. 1 | 0.69 | 1.16 | 0.72 |
| Ex. 2 | 0.65 | 1.12 | 0.78 |
| Ex. 3 | 0.71 | 1.07 | 0.69 |
| Ex. 4 | 0.69 | 1.18 | 0.85 |
| Ex. 5 | 0.75 | 1.21 | 0.97 |
| Ex. 6 | 0.98 | 1.42 | 1.05 |
| Ex. 7 | 0.71 | 1.22 | 0.85 |
| Ex. 8 | 0.70 | 1.25 | 0.92 |
| Ex. 9 | 0.70 | 1.21 | 0.82 |
| Ex. 10 | 0.71 | 1.20 | 0.73 |
| Ex. 11 | 0.71 | 1.26 | 0.82 |
| Ex. 12 | 0.76 | 1.25 | 0.87 |
| Ex. 13 | 0.65 | 1.18 | 0.80 |
| Ex. 14 | 0.84 | 1.29 | 0.94 |
| Ex. 15 | 0.77 | 1.27 | 0.89 |
| Ex. 16 | 0.88 | 1.23 | 0.99 |
| Ex. 17 | 0.80 | 1.26 | 0.96 |
| Ex. 18 | 0.88 | 1.23 | 0.92 |
| Ex. 19 | 1.03 | 1.38 | 1.28 |
| Ex. 20 | 0.91 | 1.37 | 1.27 |
| Ex. 21 | 0.83 | 1.25 | 1.07 |

TABLE 2-continued

| Example | Recording density | | recording density |
|---|---|---|---|
| Co. Ex. | 0.30 mj/dot | 0.38 mj/dot | after test |
| Ex. 22 | 0.82 | 1.27 | 1.25 |
| Ex. 23 | 1.05 | 1.42 | 1.31 |
| Ex. 24 | 0.93 | 1.35 | 1.33 |
| Ex. 25 | 0.93 | 1.36 | 1.24 |
| Ex. 26 | 0.84 | 1.30 | 1.28 |
| Ex. 27 | 0.92 | 1.35 | 1.25 |
| Ex. 28 | 1.15 | 1.41 | 1.30 |
| Co. Ex. 1 | 0.16 | 0.58 | 0.50 |
| Co. Ex. 2 | 0.53 | 0.88 | 0.65 |
| Co. Ex. 3 | 0.70 | 1.21 | 0.09 |
| Co. Ex. 4 | 0.68 | 1.22 | 0.16 |
| Co. Ex. 5 | 0.87 | 1.10 | 1.00 |

As clearly understood from above mentioned results, when a compound represented by general formula (1) is used as a color developer, the excellent recording sensitivity can be obtained by together use with a compound represented by general formula (2). And, by together use with compounds represented by general formula (3), general formula (4) or general formula (5), the recording sensitivity is further improved. Meanwhile, the Comparative Example 2 in which other sensitizer is used, sufficient color developing effect is not obtained. Therefore, it is obvious that the compound represented by general formula (2) has a remarkable sensitizing effect. The deterioration of recorded image by the contact with plasticizer contained in polyvinylchloride wrapping film which is observed in Comparative Example 3 and 4, is not observed in Examples which use compositions represented by general formula (1) as a color developer.

Effect of the Invention

The thermally sensitive recording medium of this invention, when diphenylsulfone bridgeable type compound indicated by general formula (1) is used as a color developer, it become possible to improve the color developing sensitivity and to obtain an excellent recorded image maintaining image stability such as a resistance to plasticizer, by containing said compound indicated by general formula (2). Therefore, since the sensitive and clear image can be obtained by small energy, it is suited to a high speed printing apparatus and an apparatus whose impressive energy is small and can be applied for practical use. Further, since more sensitive recording image can be obtained and the image stability is remarkably improved by containing compounds indicated by general formula (3), general formula (4) or general formula (5), it is useful.

What is claimed is:

1. A thermally sensitive recording medium which has thermally sensitive recording layer containing colorless or pale colored basic leuco dye and organic color developer as main components on a substrate, wherein said thermally sensitive recording layer contains diphenylsulfone bridgeable type compound represented by general formula (1) and at least one compound represented by general formula (2), (1)

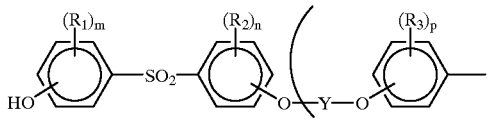

-continued

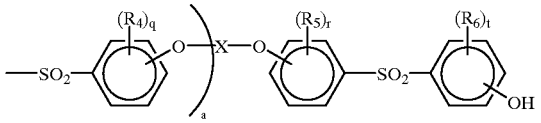

wherein, X and Y can be different and indicates a saturated or an unsaturated liner or grafted hydrocarbon group of carbon number 1–12 which can possess an ether bond, or indicate (a)

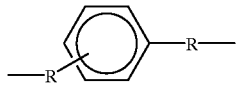

or (b)

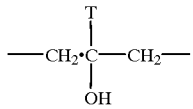

wherein R indicates a methylene group or an ethylene group, T indicates a hydrogen atom or an alkyl group of carbon number 1–4, and $R_1$–$R_6$ independently indicate a halogen atom, an alkyl group of carbon number 1–6, or an alkenyl group, further, m, n, p, q, r, t indicate an integer number of 0–4 and when are bigger than 2, $R_1$–$R_6$ can be different, and a is an integer of 0–10, (2)

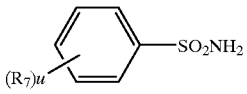

wherein, $R_7$ represents an alkyl group of carbon number 1–6 or an electron attracting group, u is an integer of 0–2.

2. The thermally sensitive recording medium of claim 1, wherein said thermally sensitive recording layer further contains at least one compound represented by general formula (3), general formula (4) and general formula (5), (3)

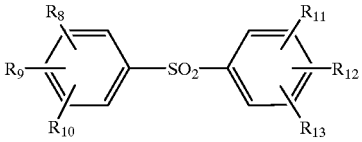

wherein, $R_8$–$R_{13}$ represent a hydrogen atom, an alkyl group, a halogen atom, a nitro group, an alkoxy group, a cyano group or an allyloxy group,

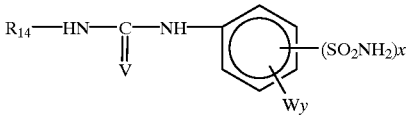

wherein, V represents an oxygen atom or a sulfur atom and $R_{14}$ represents an un-substituted or a substituted phenyl group, a naphthyl group, an aralkyl group, a lower alkyl group of carbon number 1–6, a cycloalkyl group of carbon number 3–6 or a lower alkenyl group of carbon number 2–6, W represents a lower alkyl group of carbon number 1–6 or an electron attractive group y is an integer of 1–4 and x is an integer of 1–5, wherein $y+x \leqq 5$,

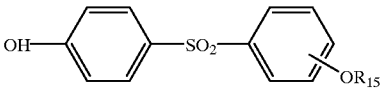

wherein, $R_{15}$ indicates an un-substituted or a substituted alkyl group of carbon number 1–4, an aralkyl group, a phenyl group or a hydrogen atom.

* * * * *